US008175304B1

(12) United States Patent
North

(10) Patent No.: US 8,175,304 B1
(45) Date of Patent: May 8, 2012

(54) COMPACT LOUDSPEAKER SYSTEM

(76) Inventor: Donald J. North, Los Angeles, CA (US)

( * ) Notice: Subject to any disclaimer, the term of this patent is extended or adjusted under 35 U.S.C. 154(b) by 1122 days.

(21) Appl. No.: 12/030,079

(22) Filed: Feb. 12, 2008

(51) Int. Cl.

| | |
|---|---|
| ***H04R 5/02*** | (2006.01) |
| ***H04R 5/04*** | (2006.01) |
| ***H04R 1/02*** | (2006.01) |
| *H04R 5/00* | (2006.01) |
| *H04R 1/00* | (2006.01) |

(52) U.S. Cl. ..... 381/308; 381/307; 381/335; 381/336; 381/17; 381/89

(58) Field of Classification Search ..... 381/308, 381/303, 304, 305, 307, 89, 334, 335, 336, 381/345, 350, 186, 17, 97, 18; 181/144, 181/153, 199

See application file for complete search history.

(56) References Cited

U.S. PATENT DOCUMENTS

| | | | | | |
|---|---|---|---|---|---|
| 3,268,030 | A | * | 8/1966 | Magnus | 181/147 |
| 3,590,942 | A | * | 7/1971 | Globa | 181/146 |
| 3,627,948 | A | * | 12/1971 | Nichols | 381/303 |
| 3,892,624 | A | * | 7/1975 | Shimada | 381/308 |
| 3,931,867 | A | * | 1/1976 | Janszen | 181/155 |
| 4,006,311 | A | * | 2/1977 | Carlsson | 381/300 |
| 4,073,365 | A | * | 2/1978 | Johnson | 181/147 |
| 4,249,037 | A | * | 2/1981 | Dexter | 381/308 |
| 4,266,092 | A | * | 5/1981 | Barker, III | 381/305 |
| 4,418,243 | A | * | 11/1983 | Fixler | 381/308 |
| 4,503,553 | A | * | 3/1985 | Davis | 381/303 |
| 4,819,269 | A | * | 4/1989 | Klayman | 381/307 |
| 4,888,804 | A | * | 12/1989 | Gefvert | 381/304 |
| 4,961,226 | A | * | 10/1990 | Saffran | 381/303 |
| 4,984,273 | A | * | 1/1991 | Aylward et al. | 381/1 |
| 5,212,732 | A | * | 5/1993 | Hipps et al. | 381/89 |
| 5,436,976 | A | * | 7/1995 | Dougherty | 381/387 |
| 5,502,772 | A | * | 3/1996 | Felder | 381/386 |
| 5,809,153 | A | * | 9/1998 | Aylward et al. | 381/337 |
| 6,069,962 | A | | 5/2000 | Miller | |
| 6,169,812 | B1 | * | 1/2001 | Miller | 381/300 |
| 6,219,426 | B1 | | 4/2001 | Daniels et al. | |
| 6,631,193 | B1 | | 10/2003 | Miller | |

(Continued)

OTHER PUBLICATIONS

Streicher, Ron, "The Decca Tree—It's Not Just for Stereo Anymore", http://www.wesdooley.com/pdf/Surround_Sound_Decca_Tree-urtext.pdf; Feb. 26, 2003; 16 pages.

*Primary Examiner* — Edgardo San Martin
(74) *Attorney, Agent, or Firm* — Knobbe Martens Olson & Bear LLP

(57) ABSTRACT

A loudspeaker configuration capable of generating stereophonic sound separation from relatively loudspeaker drivers that are not necessarily widely separated. For example, such a loudspeaker configuration can be used to generate relatively good sound separation from a single chassis, such as a single speaker box, a boom box, a clock radio or the like. This can advantageously save space in many environments. One embodiment uses four mid-tweeter speaker drivers and a bass driver. The four mid-tweeter speaker drivers are arranged facing outward approximately 90 degrees apart from each other. A speaker driver facing the listener reproduces a mid channel signal, for example, L+R. A speaker driver facing away from the listener reproduces the same mid channel signal or a delayed version of the mid channel signal. A left facing speaker reproduces a side channel, for example, L−R. A right facing speaker reproduces a side channel, for example, R−L. The acoustic combination of the sound produced by the four speaker drivers creates a virtual left and right loudspeaker as experienced by the listener.

24 Claims, 4 Drawing Sheets

U.S. PATENT DOCUMENTS 6,665,412 B1 * 12/2003 Mizoguchi ..... 381/336
3,588,355 A1 6/2007 Holm
7,457,425 B2 * 11/2008 Fincham ..... 381/302
7,606,377 B2 * 10/2009 Melanson ..... 381/97
7,817,812 B2 * 10/2010 Polk et al. ..... 381/300
2006/0078129 A1 * 4/2006 Nakamichi ..... 381/18
2007/0041599 A1 * 2/2007 Gauthier et al. ..... 381/307
2011/0216926 A1 * 9/2011 Riggs et al. ..... 381/300

* cited by examiner

COMPACT LOUDSPEAKER SYSTEM

BACKGROUND OF THE INVENTION

1. Field of the Invention

This invention generally relates to audio speaker systems. In particular, the invention relates to relatively compact speaker systems capable of reproducing a stereophonic sound.

2. Description of the Related Art

Loudspeakers include electromechanical transducers that convert electrical signals into sound. A stereo system has separate signals for a left channel (L) and for a right channel (R). To reproduce stereophonic sound, a conventional stereo system layout typically has a loudspeaker to a listener's left reproducing the left channel (L), and a loudspeaker to the listener's right reproducing the right channel (R).

In addition, in many environments, the proper placement of loudspeakers can be difficult to achieve. For example, in a portable electronic device, the left loudspeaker and the right loudspeaker may be placed so close together that the resulting stereo separation is inadequate. In another example with separate left and right loudspeakers, space on a countertop or a desktop may be too limited for relatively good placement of the loudspeakers, and in both examples best fidelity is achieved at only one listening position, usually directly in front of and centered between the left and right loudspeakers. In addition, many people do not possess the expertise necessary to position separate loudspeakers for relatively good sound field reproduction.

SUMMARY OF THE DISCLOSURE

A relatively good stereophonic sound field can be reproduced from a relatively compact chassis such as a single speaker box, a boom box, a clock radio or the like. This can advantageously save space in many environments, such as indoors. One embodiment uses four mid-tweeter speaker drivers and an optional bass driver. The four mid-tweeter speaker drivers are arranged facing outward approximately 90 degrees apart from each other. A speaker driver that faces the listener reproduces a mid channel signal, for example, L+R. A speaker driver that faces away from the listener reproduces the same mid channel signal or a delayed version of the mid channel signal. A left-facing speaker reproduces a side channel, for example, L−R. A right-facing speaker reproduces a side channel, for example, R−L. The acoustic combination of the sound produced by the four speaker drivers creates a virtual left and right loudspeaker as experienced by the listener. Accordingly, sound is radiated in 360 degrees. For example, when used in an indoor room, sound reflected off of walls can result in spacious stereo sound being heard by the listener virtually anywhere in the room.

BRIEF DESCRIPTION OF THE DRAWINGS

These drawings and the associated description herein are provided to illustrate specific embodiments of the invention and are not intended to be limiting.

DETAILED DESCRIPTION OF PREFERRED EMBODIMENTS

Although particular embodiments are described herein, other embodiments of the invention, including embodiments that do not provide all of the benefits and features set forth herein, will be apparent to those of ordinary skill in the art.

Figure 1:
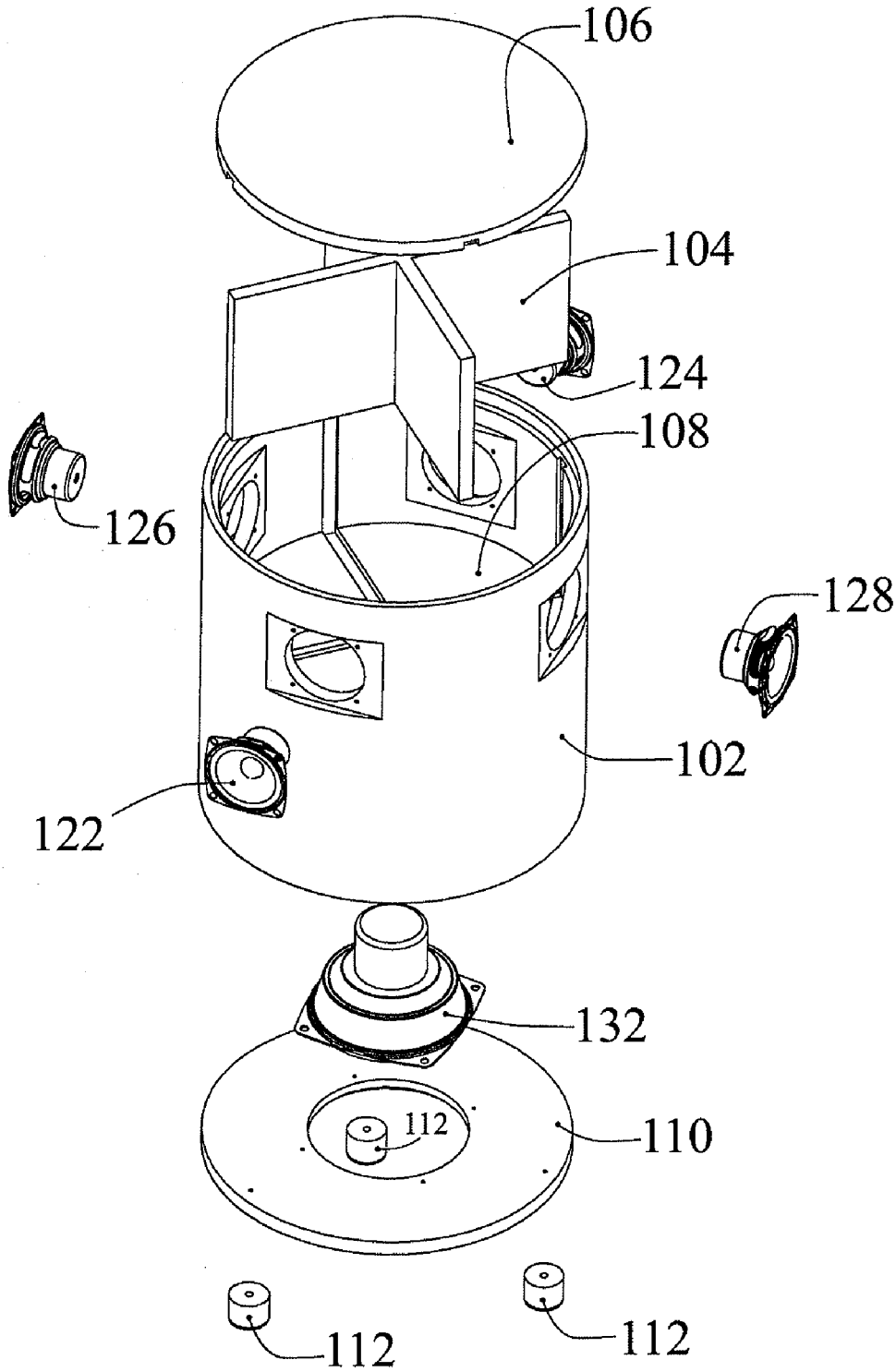
FIG. 1 illustrates an exploded perspective view of a speaker system according to an embodiment of the invention.

FIG. 1 illustrates an exploded perspective view of a speaker system according to an embodiment of the invention. The illustrated speaker system includes a chassis 102, which in the illustrated embodiment forms part of an enclosure. Stereo sound can be generated from the speaker system by itself, that is, without another speaker system to form a left and right pair. The enclosure of the illustrated speaker system also includes a first baffle 104, a top 106, an inner floor 108, a woofer baffle 110, and feet 112. The chassis is configured to hold an array of speaker drivers.

Each of the speaker drivers of the array faces outwards. In the illustrated embodiment, the array includes a front-facing speaker driver 122, a rear-facing speaker driver 124, a left-facing speaker driver 126, and a right-facing speaker driver 128. Optionally, the speaker drivers 122, 124, 126, 128 are aligned in a common horizontal plane.

Optionally, each of the speaker drivers 122, 124, 126, 128 can be equidistant from a common point. The speaker drivers 122, 124, 126, 128 can accordingly be used with an enclosure having a circular cross-section, such as the illustrated cylinder shown. However, other shapes can be used, such as, a square cross-section box. In addition, it should be noted that the chassis can correspond to structures other than enclosures, such as, but not limited to, a frame that holds individual enclosures for the speaker drivers 122, 124, 126, 128. Preferably, a single-chassis is used, as a single-chassis helps to ensure that the speaker drivers 122, 124, 126, 128 are properly arranged for their driving signals. However, more than one chassis can be used. In alternative embodiments, the speaker drivers 122, 124, 126, 128 are not equidistant from a common point, and other configurations of chassis can be used. Optionally, the speaker system can also include a woofer 132 to assist the reproduction of relatively low-frequency sounds.

One example of a schematic describing the signals provided to the speaker drivers 122, 124, 126, 128 is described in connection with FIG. 4. A conventional stereo system has a left channel (L) signal and a right channel (R) signal. In a conventional stereo system, a loudspeaker to the listener's left reproduces the left channel (L) signal and a loudspeaker to the listener's right reproduces the right channel (R).

The left channel (L) signal and the right channel (R) signal can be summed to form a mid channel (M) signal. The mid channel (M) signal can be generated in analog domain or digital domain. In one embodiment, summing is performed in analog domain to save cost. Examples of such summing circuits include resistive summing networks, op-amp summing circuits, such as a non-inverting summing amplifier, and the like. Other techniques can also be used to sum the left channel (L) signal and the right channel (R) signal, such as summing using dual voice coils, summing by wiring across differential output amplifiers, and the like. The particular technique used to generate the mid channel (M) signal is not critical, and it should be noted that some techniques apply before power amplification and some apply after power amplification.

A side channel (S) signal can be formed from the difference between the left channel (L) signal and the right channel (R)

signal or vice-versa. The side channel (S) signal can also be generated in either the analog domain or the digital domain. In one embodiment, the side channel (S) signal is generated in analog domain. For example, an op-amp circuit known as a difference amplifier can be used to generate the side channel (S) signal. Other techniques can also be used generate the side channel (S) signal, such as, but not limited to, using dual voice coils, appropriate connection across differential output amplifiers, transformer circuits, and the like. The particular technique used to generate the side channel (S) signal is not critical, and it should be noted that some techniques apply before power amplification and some apply after power amplification. While the side channel (S) signal will be described in the context of the difference (L−R) between the left channel (L) signal and the right channel (R) signal, the opposite (R−L) can be used (with corresponding changes). The acoustic combination of an omnidirectional or a cardioid loudspeaker reproducing the mid channel (M) signal together with a dipole loudspeaker crossed 90 degrees reproducing the side channel (S) signal creates a virtual left and right loudspeaker. For improved performance, the acoustic centers of the omnidirectional or the cardioid loudspeaker configuration and the dipole loudspeaker configuration are preferably coincident.

One embodiment will now be described in greater detail. For the purposes of illustration, each speaker driver will be assumed to have one voice coil, a M-S processor 402 (FIG. 4) generates the mid channel (M) signal and the side channel (S) signal before a power amplification stage, and the mid channel (M) signal and the side channel (S) signal are each individually available at outputs of power amplifiers. In the illustrated embodiment, the side channel (S) corresponds to the left minus right difference (L−R), but of course, the opposite can be used with corresponding changes.

The left-facing speaker driver 126 is coupled to the side channel (S) signal such that the left minus right difference signal (L−R signal)(FIG. 4) is reproduced by the left-facing speaker driver 126. The right-facing speaker driver 128 is coupled to the side channel (S) such that the right minus left difference (R−L) is reproduced by the right-facing speaker driver 128. In the illustrated embodiment of FIG. 4, this is accomplished by wiring an output of the power amplifier 404 (FIG. 4) for the L−R signal in phase for the left-facing speaker driver 126 and out-of-phase for the right-facing speaker driver 128. This configuration produces the sound field of the side channel (S) signal as a dipole sound source.

Figure 4:
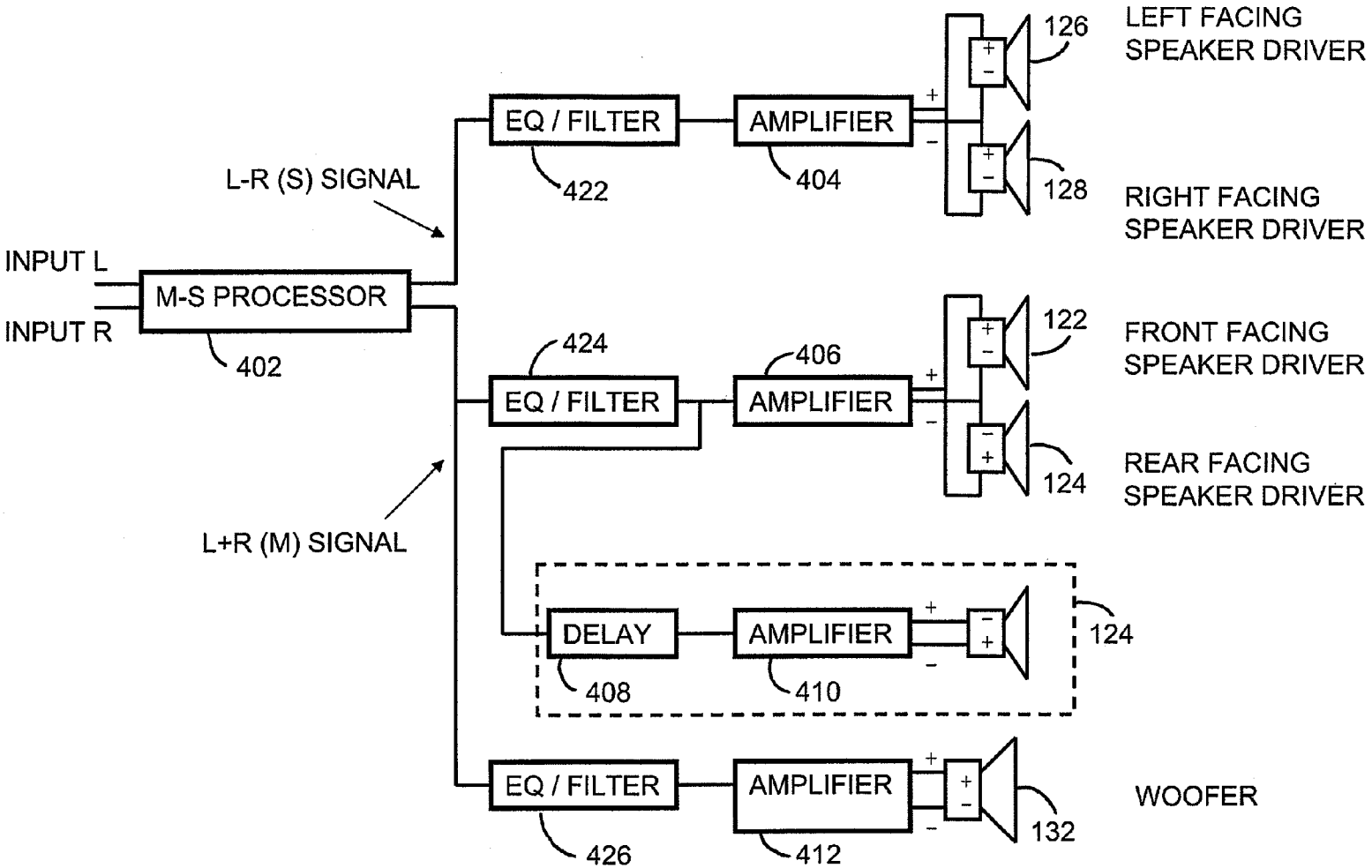
FIG. 4 is a schematic diagram illustrating a circuit that can be used to process signals and drive speaker drivers of the speaker system.

In one embodiment, the front-facing speaker driver 122 is coupled to the mid channel (M) signal, which is depicted in FIG. 4 as the L+R signal. This mid channel (M) signal is amplified by a power amplifier 406 (FIG. 4). The rear-facing speaker driver 124 can also be coupled to the mid channel (M) signal (in phase). This configuration produces the sound field of the mid channel (M) signal as an omnidirectional sound source relatively well. When the speaker drivers 122, 124, 126, 128 are relatively small, share a common horizontal plane, and are equidistant from a reference point, such as, but not limited to, a point in the center of a chassis, the acoustic centers of the dipole and the omnidirectional loudspeaker configurations are aligned and coincident.

In an alternative embodiment having a delay stage 408 (FIG. 4) and an additional amplifier 410 (FIG. 4), rather than driving the rear-facing speaker driver directly with the mid channel (M) signal, the rear-facing speaker driver 124 is driven by a delayed version of the mid channel (M) signal and connected out of phase with respect to the front-facing speaker driver 122. In one embodiment, the phase change is accomplished by inverting the connections at the speaker terminals for the rear-facing speaker driver 124. The delayed version is delayed so that sound emanating from the front-facing speaker driver 122 is aligned in time with the out-of-phase sound emanating from the rear-facing speaker driver 124 at the rear-facing speaker driver 124, which sets up destructive interference. This configuration produces the sound field of a cardioid sound source relatively well. In one embodiment, the delay can be activated at the option of the listener to permit the listener to select the listening configuration.

When the speaker drivers 122, 124, 126, 128 are relatively small, share a common horizontal plane, and are equidistant from a reference point, such as, but not limited to, a point in the center of a chassis, with delay added to the rear-facing speaker driver 124, the acoustic centers of the dipole and cardioid loudspeakers are aligned and coincident. The speaker drivers 122, 124, 126, 128 are preferably relatively small, such as from about 1 inch to 3 inches in diameter for cone-type speaker drivers, to better create the sound radiation pattern of the omnidirectional, cardioid, and dipole loudspeakers throughout the audible frequency range, particularly into the treble. Of course, other types of drivers can also be used.

With the speaker drivers 122, 124, 126, 128 spaced 90 degrees apart, sound is radiated in 360 degrees, creating good fidelity at virtually any listening position. Furthermore when used indoors, the 360-degree radiated sound reflects off of walls and can result in a spacious stereo sound being heard by the listener at essentially any position in the room.

Larger diameter speaker drivers will typically not permit the front-facing speaker driver 122 and the rear-facing speaker driver 124 to replicate a relatively good omnidirectional sound source or permit the left-facing speaker driver 126 and the right-facing speaker driver 128 to replicate a relatively good dipole sound source. For example, beyond about 3 inches in diameter, a speaker driver will typically be too directional at high frequency, thereby preventing the mid channel (L+R) and side channel (L−R and/or R−L) from the 4 speakers from mixing properly to replicate sound from virtual left and right loudspeakers. Preferably, the side channels are "pure" differences (L−R) or (R−L) as illustrated. However, a blend can be used. For example, the left-facing speaker driver 126 can be driven with a blend of the left (L) signal and the left minus right (L−R) side channel, and the right-facing speaker driver 128 can be driven with a blend of the right (R) signal and the right minus left (R−L) side channel. When blended, the signals can be blended such that the signal applied to the left-facing speaker driver 126 is (nL−R) and the signal applied to the right-facing speaker driver 128 is (nR−L) (not normalized). In one embodiment, the value of n is in a range from about 1 to about 3.

In the illustrated embodiment, each of the speaker drivers 122, 124, 126, 128 corresponds to a 2 inch mid-tweeter model 830970 available from Peerless. Other appropriate speaker drivers will be readily determined by one of ordinary skill in the art. When relatively small speaker drivers 122, 124, 126, 128 are used as suggested for a relatively good sound field, the woofer 132 can optionally be used to supplement low-frequency (bass) response.

A wide range of speaker drivers can be used for the woofer 132. An appropriate woofer can be readily selected by one of ordinary skill in the art based on size, weight, and cost constraints. For example, 4 inch to 6 inch woofers can be effective, but other sizes will be applicable. The illustrated woofer 132 is mounted facing a bottom of the chassis 102. This saves space and permits the speaker drivers 122, 124, 126, 128 of the array to be closer together. The woofer 132 can alternatively be mounted on a side, on top, or even in another chassis.

Preferably, the speaker drivers 122, 124, 126, 128 are evenly spaced across 360 degrees as viewed from above or below. For example, a square cross-section enclosure will typically ensure even spacing and equidistant spacing from a reference point between the speaker drivers 122, 124, 126, 128. However, the spacing can be other than 90 degrees apart. For example, the spacings can be 90 degrees +/−10 degrees. In addition, while illustrated with each speaker driver pointing radially outward from a common reference point, the speaker drivers can also be pivoted slightly with respect to the outward direction. For example, the left-facing speaker driver 126 and the right-facing speaker driver 128 can be pivoted or tilted towards the listener if desired and still be generally facing outward.

Other mechanical components of the speaker system will now be described. The chassis 102, the first baffle 104, the top 106, and the inner floor 108 form enclosures for the speaker drivers 122, 124, 126, 128 of the array. The chassis 102, the inner floor 108, and the woofer baffle 110 form an enclosure for the baffle 132. While illustrated in the context of sealed enclosures, other types of enclosures, such as ported enclosures, can also be applicable. The feet 112 permit for air to flow below the woofer 132. In the illustrated embodiment, the feet 112 are about 0.75 inches in height. The various mechanical components can be made out of a variety of materials, such as, but not limited to, wood, plastics, metals, or combinations thereof.

Figure 2:
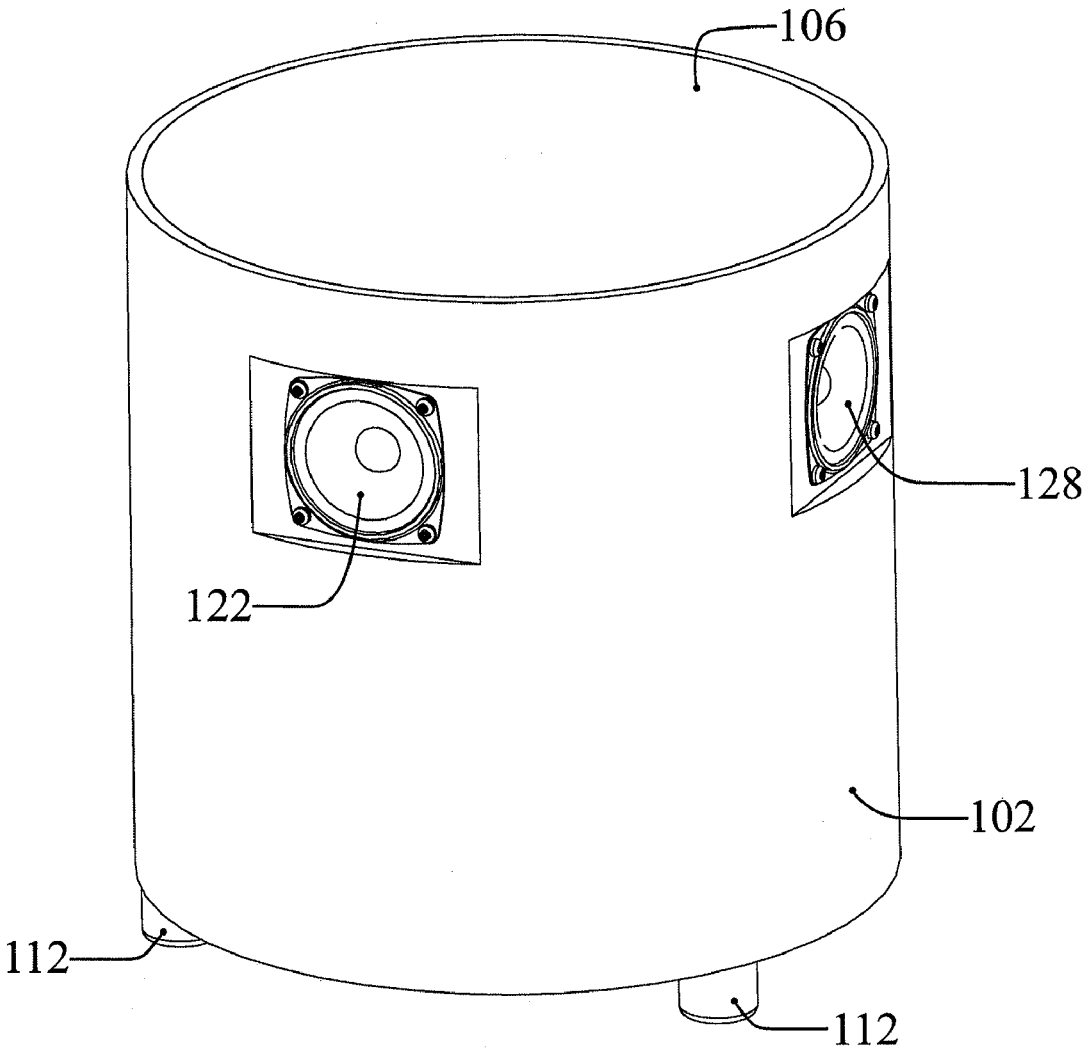
FIG. 2 illustrates a perspective view of the speaker system viewed from the front, above, and right side.

FIG. 2 illustrates a perspective view of the speaker system viewed from the front, above, and right side, with the components assembled. While the top 106 shown is featureless, the top 106 or other surfaces can have one or more of input connectors for an audio device, power connectors, displays, controls (such as selector switches, volume controls, etc.) and the like. One or more grilles covering the various speaker drivers are also not drawn for clarity, but can be included with the speaker system. In addition, other components such as players, power supplies, radio or satellite receivers, etc., can be integrated with the speaker system.

Figure 3:
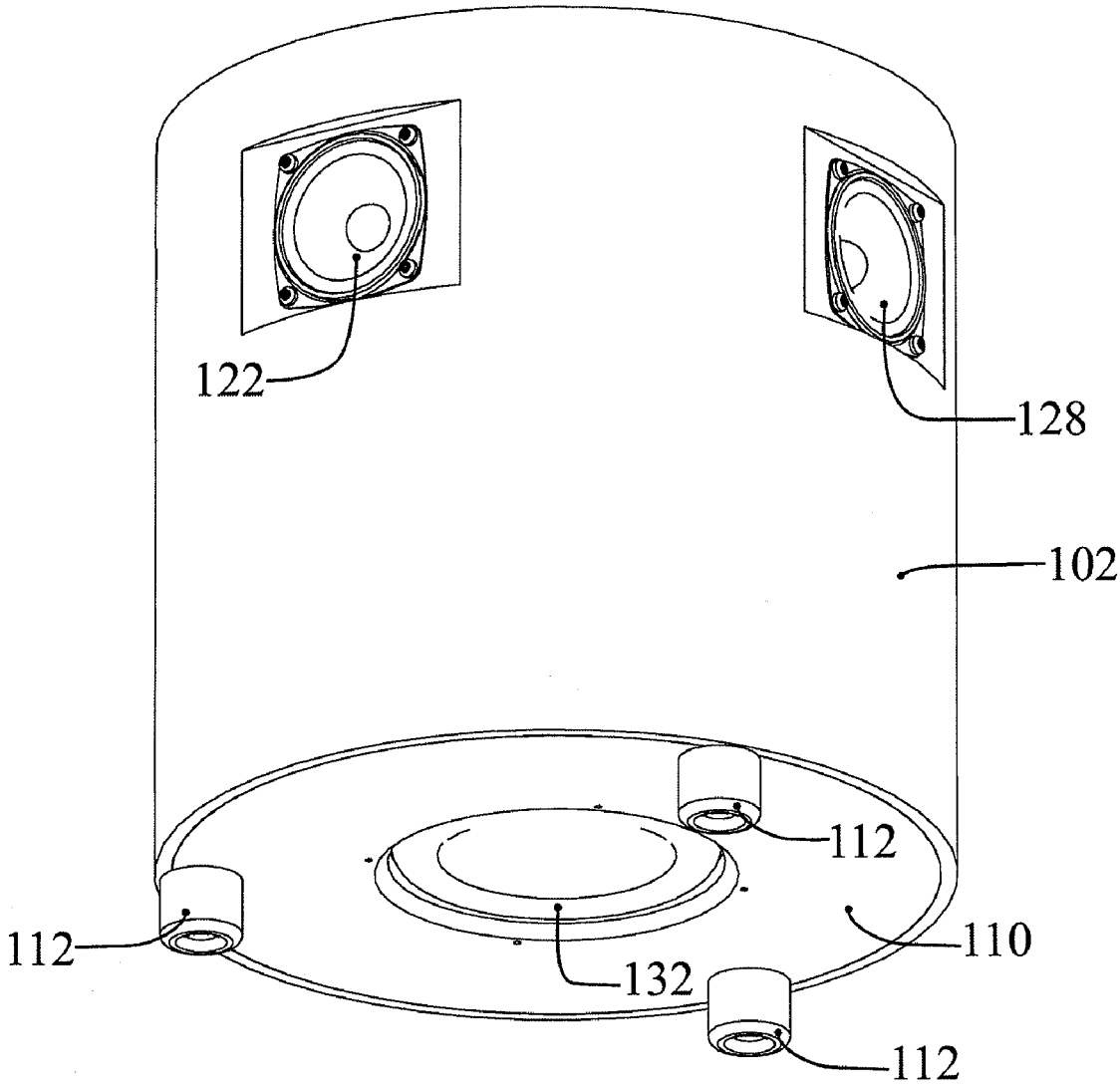
FIG. 3 illustrates a perspective view of the speaker system viewed from the front, below, and right side.

FIG. 3 illustrates a perspective view of the speaker system viewed from the front, below, and right side, with the components assembled. The woofer 132 is visible in this view.

FIG. 4 is a schematic diagram illustrating a circuit that can be used to process signals and drive speaker drivers of the speaker system. In the illustrated schematic, the M-S (mid-side) channel process is performed at a pre-amplifier level, but one of ordinary skill in the art will appreciate that other configurations are possible.

The left channel (L) signal and the right channel (R) signal are provided as inputs to the M-S processor 402. For example, the left channel (L) and the right channel (R) can be provided from a CD player, satellite receiver, radio, digital audio player, such as an iPod or the like. The signals can be received through a wired connection or wirelessly. Other components, such as input selectors, volume controls, tone controls, or the like can also be provided. For clarity, these possible other features have been left off of FIG. 4.

The M-S processor 402 of the illustrated embodiment converts the left channel (L) signal and the right channel (R) signal into a mid channel signal and a side channel signal. The mid channel signal is represented by the L+R signal. The side channel(s) can be either or both of L−R or R−L, and is illustrated in FIG. 4 as the L−R signal.

The L−R signal is provided as an input to an equalizer/filter 422. The equalizer/filter 422 can correspond to a high-pass crossover network for the left-facing speaker driver 126 and the right-facing speaker driver 128, and can include equalization. The equalizer/filter 422 can be optional. The equalized/filtered L−R signal is then amplified by the power amplifier 404. With the L−R signal, the amplifier outputs are coupled in-phase for the left-facing speaker driver 126 and out-of-phase for the right-facing speaker driver 128. If an R−L signal is used, the wiring described can be reversed at the speaker terminals.

The L+R signal can be equalized/filtered by an equalizer/filter 424. The equalizer/filter 424 can be optional. In one embodiment, the L+R signal is then amplified by the power amplifier 406, and is then provided in phase to both the front-facing speaker driver 122 and to the rear-facing speaker driver 124. This approximates the sound field produced by an omnidirectional sound source relatively well.

In an alternative embodiment, the L+R signal (either with or without equalization/filtering) is amplified by the power amplifier 406 and provided in phase to the front-facing speaker driver 122. The L+R signal (either with or without equalization/filtering) is also provided as an input to the delay stage 408 and then to the power amplifier 410. The delay stage 408 can be implemented by, for example, a passive network. The delay stage 408 can also be implemented digitally with an analog-to-digital converter, a memory, and a digital-to-analog converter. The L+R signal is then provided not only delayed, but also out-of-phase to the rear-facing speaker driver 124. With a delay set to match the propagation delay of sound from the front-facing speaker driver 122 to the rear-facing speaker driver 124, the delay and inversion set up destructive interference at the rear-facing speaker. This approximates the sound field produced by a cardioid sound source relatively well. It should be noted that the phase can be inverted other ways, such as electronically before power amplification.

The schematic also illustrates an equalizer/filter 428 and a power amplifier 412 for the woofer 132. The woofer 132 and corresponding circuits can be optional. In addition, any of the equalizer/filters can include gain adjustments for matching of levels from the various speaker drivers.

Various embodiments have been described above. Although described with reference to these specific embodiments, the descriptions are intended to be illustrative and are not intended to be limiting. Various modifications and applications may occur to those skilled in the art.

What is claimed is:

1. An apparatus configured to reproduce sound audible to humans, the apparatus comprising:

an array of speaker drivers comprising a front-facing speaker driver, a rear-facing speaker driver, a left-facing speaker driver, and a right-facing speaker driver, wherein each of the front-facing speaker driver, the rear-facing speaker driver, the left-facing speaker driver, and the right-facing speaker driver is generally facing outward, wherein the front-facing speaker driver, the rear-facing speaker driver, the left-facing speaker driver, and the right-facing speaker driver are mounted in a single chassis; and a circuit configured to drive the front-facing speaker driver with a mid channel signal comprising a sum of a left channel signal and a right channel signal, wherein the circuit is configured to drive the rear-facing speaker driver with a signal having the same content as the mid channel signal, wherein the circuit is configured to drive the left-facing speaker driver at least partially with a side channel signal comprising a difference between the left channel signal and the right channel signal, and wherein the circuit is configured to drive the right-facing speaker driver such that the right-facing speaker driver has side channel signal content that is out-of-phase with respect to the left-facing speaker driver.

2. The apparatus of claim 1, wherein the circuit is configured to drive the left-facing speaker driver with a left minus right (L–R) signal, and wherein the circuit is configured to drive the right-facing speaker driver with a right minus left (R–L) signal.

3. The apparatus of claim 1, wherein the circuit is configured to drive the left facing speaker driver with a blend of a left (L) signal and a left minus right (L–R) signal, and wherein the circuit is configured to drive the right-facing speaker driver with a blend of a right (R) signal and a right minus left (R–L) signal.

4. The apparatus of claim 1, wherein the single chassis is configured to arrange the front-facing speaker driver, the rear-facing speaker driver, the left-facing speaker driver, and the right-facing speaker driver in a circular pattern such that each of the front-facing speaker driver, the rear-facing speaker driver, the left-facing speaker driver, and the right-facing speaker driver is equidistant from a reference point.

5. The apparatus of claim 4, wherein the single chassis is further configured to arrange the front-facing speaker driver, the rear-facing speaker driver, the left-facing speaker driver, and the right-facing speaker driver in a horizontal plane.

6. The apparatus of claim 1, wherein each of the speaker drivers of the array comprises a mid-tweeter.

7. The apparatus of claim 1, further comprising a fifth speaker transducer comprising a woofer, wherein the woofer is not part of the array.

8. The apparatus of claim 7, wherein the single chassis is configured to arrange the front-facing speaker driver, the rear-facing speaker driver, the left-facing speaker driver, and the right-facing speaker driver in a circular pattern when viewed from above, wherein the single chassis is further configured to arrange the front-facing speaker driver, the rear-facing speaker driver, the left-facing speaker driver, and the right-facing speaker driver in a horizontal plane, wherein the single chassis is further configured to arrange the woofer such that the woofer faces down.

9. The apparatus of claim 1, wherein the circuit is further configured:

to receive a left channel signal and a right channel signal; and to process the left channel signal and the right channel signal to generate the mid channel signal and the side channel signal.

10. The apparatus of claim 9, wherein the circuit comprises:

a first amplifier configured to amplify the mid channel signal, wherein the front-facing speaker driver and the rear-facing speaker driver are coupled to an output of the first amplifier; and a second amplifier configured to amplify the side channel signal, wherein the left-facing speaker driver is coupled in phase to an output of the second amplifier, and wherein the right-facing speaker driver is coupled out-of-phase to the output of the second amplifier.

11. An apparatus configured to reproduce sound audible to humans, the apparatus comprising:

an array of speaker drivers comprising a front-facing speaker driver, a rear-facing speaker driver, a left-facing speaker driver, and a right-facing speaker driver, wherein each of the front-facing speaker driver, the rear-facing speaker driver, the left-facing speaker driver, and the right-facing speaker driver is generally facing outward; and a circuit configured to drive the front-facing speaker driver with a mid channel signal, wherein the circuit is configured to drive the rear-facing speaker driver with a signal having the same content as the mid channel signal, wherein the circuit is configured to drive the left-facing speaker driver at least partially with a side channel signal, wherein the circuit is configured to drive the right-facing speaker driver such that the right-facing speaker driver has side channel signal content that is out-of-phase with respect to the left-facing speaker driver, wherein the circuit is configured to receive a left channel signal and a right channel signal, and wherein the circuit is configured to process the left channel signal and the right channel signal to generate the mid channel signal and the side channel signal;

a delay circuit configured to delay the mid channel signal to generate a delayed mid channel signal;

a first amplifier configured to amplify the mid channel signal, wherein the front-facing speaker driver is coupled to an output of the first amplifier;

a second amplifier configured to amplify the delayed mid channel signal, wherein the rear-facing speaker driver is coupled to an output of the second amplifier, wherein the delayed mid channel signal is delayed from the mid channel signal such that sound waves emanating from the front-facing speaker and sound waves emanating from the rear-facing speaker are substantially aligned at the rear-facing speaker, wherein the rear-facing speaker driver is out-of-phase with respect to the front-facing speaker driver such that destructive interference of the sound waves occurs towards the rear of the apparatus; and a third amplifier configured to amplify the side channel signal, wherein the left-facing speaker driver is coupled in phase to an output of the third amplifier, and wherein the right-facing speaker driver is coupled out-of-phase to the output of the third amplifier.

12. The apparatus of claim 11, wherein the delay circuit is configurable to disable the delay.

13. The apparatus of claim 11, wherein the circuit is configured to receive the left channel signal and the right channel signal via one or more electrical connectors.

14. The apparatus of claim 11, further comprising a wireless interface, wherein the circuit is configured to receive the left channel signal and the right channel signal via the wireless interface.

15. The apparatus of claim 11, further comprising:

a chassis configured to arrange the front-facing speaker driver, the rear-facing speaker driver, the left-facing speaker driver, and the right-facing speaker driver in a circular pattern when viewed from above, wherein the chassis is further configured to arrange the front-facing speaker driver, the rear-facing speaker driver, the left-facing speaker driver, and the right-facing speaker driver in a horizontal plane;

a fifth speaker transducer comprising a woofer, wherein the chassis is further configured to arrange the woofer such that the woofer faces down;

wherein the circuit is further configured to receive a left channel signal and a right channel signal, and to process the left channel signal and the right channel signal to generate the mid channel signal and the side channel signal; and a first amplifier for at least the mid channel signal and a second amplifier for at least the side channel signal.

16. A method of reproducing sound, the method comprising:

reproducing a first mid channel signal using a first speaker driver generally facing a listener, wherein the first mid channel signal is generated from a left channel signal and a right channel signal;

reproducing a second mid channel signal using a second speaker driver generally facing away from the listener, wherein the second mid channel signal can be the same signal as or a different signal than the first mid channel signal, wherein the second mid channel signal is generated from the left channel signal and the right channel signal;

reproducing a first side channel signal using a third speaker driver generally facing outward in a direction parallel with the listener's left, wherein the first side channel signal is generated from a difference between the left channel signal and the right channel signal; and reproducing a second side channel signal using a fourth speaker driver generally facing outward in a direction parallel with the listener's right, wherein the second side channel signal is out of phase with respect to the first side channel signal, wherein the second side channel is generated from a difference between the left channel signal and the right channel signal;

wherein the first speaker driver, the second speaker driver, the third speaker driver, and the fourth speaker driver are arranged in a single chassis.

17. The method of claim 16, wherein the second mid channel signal is the same signal as the first mid channel signal.

18. A method of reproducing sound, the method comprising:

reproducing a first mid channel signal using a first speaker driver generally facing a listener, wherein the first mid channel signal is generated from a left channel signal and a right channel signal;

reproducing a second mid channel signal using a second speaker driver generally facing away from the listener, wherein the second mid channel signal can be the same signal as or a different signal than the first mid channel signal, wherein the second mid channel signal is generated from the left channel signal and the right channel signal;

reproducing a first side channel signal using a third speaker driver generally facing outward in a direction parallel with the listener's left, wherein the first side channel signal is generated from a difference between the left channel signal and the right channel signal;

reproducing a second side channel signal using a fourth speaker driver generally facing outward in a direction parallel with the listener's right, wherein the second side channel signal is out of phase with respect to the first side channel signal, wherein the second side channel is generated from a difference between the left channel signal and the right channel signal; and delaying and inverting the second mid channel signal relative to the first mid channel signal such that sound waves emanating from the first speaker driver and sound waves emanating from the second speaker driver are substantially aligned at the second speaker driver such that destructive interference occurs.

19. The method of claim 18, wherein the second side channel signal is an inverted version of the first side channel signal.

20. The method of claim 18, wherein the first side channel signal comprises a left minus right (L−R) signal, and the second side channel signals comprises a right minus left (R−L) signal.

21. The method of claim 18, wherein the first side channel signal comprises a blend of a left (L) signal and a left minus right (L−R) signal, and the second side channel signals comprises a blend of a right (R) signal and a right minus left (R−L) signal.

22. The method of claim 18, wherein the first speaker driver, the second speaker driver, the third speaker driver, and the fourth speaker driver are configured to reproduce sound above a first frequency, further comprising reproducing sounds at least below the first frequency using a fifth speaker driver.

23. The method of claim 22, wherein the first speaker driver, the second speaker driver, the third speaker driver, the fourth speaker driver, and the fifth speaker driver are arranged in a single chassis.

24. The apparatus of claim 11, wherein the front-facing speaker driver, the rear-facing speaker driver, the left-facing speaker driver, and the right-facing speaker driver are arranged in a single chassis.

* * * * *